US008051822B2

(12) United States Patent
Yorita et al.

(10) Patent No.: US 8,051,822 B2
(45) Date of Patent: Nov. 8, 2011

(54) SPARK PLUG AND CYLINDER HEAD ASSEMBLY ENSURING RELIABLE IGNITION OF AIR/FUEL MIXTURE

(75) Inventors: Hiroshi Yorita, Anjo (JP); Masamichi Shibata, Toyota (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 518 days.

(21) Appl. No.: 12/143,161

(22) Filed: Jun. 20, 2008

(65) Prior Publication Data

US 2008/0314354 A1 Dec. 25, 2008

(30) Foreign Application Priority Data

Jun. 22, 2007 (JP) ..... 2007-165195

(51) Int. Cl.
*F01M 1/02* (2006.01)

(52) U.S. Cl. ..... 123/169 R; 123/193.5; 123/143 R; 123/146.5 R; 313/141

(58) Field of Classification Search ..... 123/671, 123/193.1–193.6, 627, 608, 143 R, 146.5 R, 123/169 R; 313/141, 118, 142, 143, 144, 313/139, 124
See application file for complete search history.

(56) References Cited

U.S. PATENT DOCUMENTS

| | | | | |
|---|---|---|---|---|
| 2,251,179 | A * | 7/1941 | Weinerth | 313/142 |
| 2,393,497 | A * | 1/1946 | Gregory | 313/145 |
| 2,446,888 | A * | 8/1948 | Sheridan et al. | 361/268 |
| 3,320,461 | A * | 5/1967 | Feins | 313/125 |
| 3,346,760 | A * | 10/1967 | Jalbing et al. | 313/136 |
| 3,612,931 | A * | 10/1971 | Strumbos | 313/11.5 |
| 3,668,749 | A * | 6/1972 | Podiak et al. | 445/7 |
| 4,841,925 | A * | 6/1989 | Ward | 123/143 B |
| 4,974,559 | A * | 12/1990 | Nagaoka | 123/169 PA |
| 5,210,458 | A * | 5/1993 | McDougal | 313/130 |
| 5,831,377 | A * | 11/1998 | Matsubara et al. | 313/141 |
| 5,873,338 | A * | 2/1999 | Matsubara et al. | 123/169 EL |
| 6,583,538 | B1 * | 6/2003 | Adolf et al. | 313/141 |
| 7,164,225 | B2 * | 1/2007 | Yoshimoto et al. | 313/141 |
| 2006/0042610 | A1 * | 3/2006 | Abe et al. | 123/635 |
| 2006/0202599 | A1 * | 9/2006 | Kato | 313/143 |

FOREIGN PATENT DOCUMENTS

| | | | |
|---|---|---|---|
| EP | 0453277 | A1 * | 4/1991 |
| JP | 01-302678 | | 12/1989 |
| JP | 5-87274 | | 11/1993 |

OTHER PUBLICATIONS

Japanese Office Action dated May 19, 2009, issued in corresponding Japanese Application No. 2007-165195, with English translation.

* cited by examiner

*Primary Examiner* — Michael Cuff
*Assistant Examiner* — Hung Q Nguyen
(74) *Attorney, Agent, or Firm* — Nixon & Vanderhye PC

(57) ABSTRACT

A spark plug and cylinder head assembly includes a spark plug and a cylinder head of an engine. The cylinder head has a bore and a surface which faces a combustion chamber of the engine and on which the bore opens. The spark plug is fit in the bore of the cylinder head, and includes a metal shell, an insulator retained in the metal shell, a center electrode secured in the insulator, and a ground electrode facing the center electrode through a spark gap. An end surface of the metal shell has an outer edge and an inner edge, and tapers from the outer edge to the inner edge in a direction toward the inside of an air pocket formed between the metal shell and the insulator. The outer edge of the end surface of the metal shell protrudes from the surface of the cylinder head into the combustion chamber.

3 Claims, 9 Drawing Sheets

SPARK PLUG AND CYLINDER HEAD ASSEMBLY ENSURING RELIABLE IGNITION OF AIR/FUEL MIXTURE

CROSS-REFERENCE TO RELATED APPLICATION

This application is based on and claims priority from Japanese Patent Application No. 2007-165195, filed on Jun. 22, 2007, the content of which is hereby incorporated by reference in its entirety into this application.

BACKGROUND OF THE INVENTION

1. Technical Field of the Invention

The present invention relates generally to spark plugs and their mounting in cylinder heads of engines. More particularly, the invention relates to a spark plug and cylinder head assembly which can be made at low cost and ensure reliable ignition of the air/fuel mixture in a combustion chamber of an engine.

2. Description of the Related Art

In an internal combustion engine of a motor vehicle, there is mounted, in a cylinder head of the engine, a spark plug for igniting the air/fuel mixture in a combustion chamber of the engine.

The spark plug includes a center electrode and a ground electrode, and discharges sparks across a spark gap formed between the center and ground electrodes. The discharged sparks then causes the formation of a flame core, and the flame grows around the flame core to ignite the air/fuel mixture.

However, when the flame core is formed too close to an inside surface of the cylinder head which faces the combustion chamber, the flame core will be cooled by the inside surface, hindering the growth of the flame.

To solve the above problem, one may consider locating the spark gap of the spark plug deep into the combustion chamber. However, in this case, the temperature of the ground electrode will become too high, causing a pre-ignition of the air/fuel mixture.

Japanese Utility Model Publication No. H5-87274 discloses a spark plug and cylinder head assembly which is made by mounting a spark plug in a cylinder head of an engine. In this assembly, the spark plug includes an air pocket that is formed between a metal shell and an insulator of the spark plug and opens to a combustion chamber defined by the cylinder head. A communication hole is formed in the metal shell to extend between the air pocket and an outer side surface of the metal shell. Further, a communication path is formed in the cylinder head to fluidically connect the air pocket of the spark plug to the combustion chamber. In operation, a flow of the air/fuel mixture is induced through both the communication path and the communication hole, expelling the air/fuel mixture having entered the air pocket of the spark plug to the combustion chamber.

The above spark plug and cylinder head assembly may be effective in shifting sparks induced in the spark gap of the spark plug away from the inside surface of the combustion chamber.

However, to make the spark plug and cylinder head assembly, it is necessary to form the communication hole in the metal shell of the spark plug and the communication path in the cylinder head and to accurately align the communication hole with the communication path. Consequently, both the manufacturing and assembly processes of the spark plug and the cylinder head become complicated, increasing the cost of the resultant spark plug and cylinder head assembly.

SUMMARY OF THE INVENTION

The present invention has been made in view of the above-mentioned problems.

It is, therefore, a primary object of the present invention to provide a spark plug and cylinder head assembly which can be made at low cost and ensure reliable ignition of the air/fuel mixture in a combustion chamber of an engine.

According to the present invention, there is provided a first spark plug and cylinder head assembly which includes a cylinder head of an engine and a spark plug.

The cylinder head has formed therein a bore. The cylinder head also has a surface which faces a combustion chamber of the engine and on which the bore opens. The spark plug is provided to ignite the air/fuel mixture in the combustion chamber of the engine. The spark plug includes: a) a tubular metal shell fit in the bore of the cylinder head with a longitudinal direction of the metal shell perpendicular to the surface of the cylinder head, the metal shell having an end surface facing the combustion chamber and an inner shoulder that is formed on an inner periphery of the metal shell away from the end surface in the longitudinal direction; b) an insulator having an outer shoulder formed on an outer periphery of the insulator, the insulator being retained in the metal shell through an engagement between the inner shoulder of the metal shell and the outer shoulder of the insulator; c) an air pocket formed between the metal shell and the insulator, the air pocket extending, in the longitudinal direction of the metal shell, from the inner shoulder to the end surface of the metal shell to open to the combustion chamber; d) a center electrode secured in the insulator; and e) a ground electrode joined to the metal shell and facing the center electrode through a spark gap formed therebetween.

Further, in the first spark plug and cylinder head assembly, the end surface of the metal shell has an outer edge and an inner edge, and tapers from the outer edge to the inner edge in a direction toward the inner shoulder of the metal shell. The outer edge of the end surface of the metal shell protrudes from the surface of the cylinder head into the combustion chamber.

With the above configuration of the first assembly, sparks induced in the spark gap will be shifted away from the surface of the cylinder head. Consequently, the flame core will be formed at a position sufficiently far from the surface of the cylinder head, facilitating the growth of the flame. As a result, the air/fuel mixture can be reliably ignited in the combustion chamber. Moreover, with the above configuration, it is unnecessary to form a communication hole in the metal shell of the spark plug and a communication path in the cylinder head and to accurately align the communication hole with the communication path. Accordingly, the first spark plug and cylinder head assembly can be made at low cost.

Preferably, in the above first spark plug and cylinder head assembly, a taper angle $\theta$ of the end surface of the metal shell, which represents an angle between the end surface of the metal shell and the surface of the cylinder head, is in the range of 20 to 40°.

Moreover, a protruding height H of the metal shell, which represents a distance from the surface of the cylinder head to the outer edge of the end surface of the metal shell in the longitudinal direction of the metal shell, is preferably in the range of 0.5 to 1.5 mm.

According to the present invention, there is also provided a second spark plug and cylinder head assembly which includes a cylinder head of an engine and a spark plug.

The cylinder head has formed therein a bore. The cylinder head also has a surface which faces a combustion chamber of the engine and on which the bore opens. The spark plug is provided to ignite the air/fuel mixture in the combustion chamber of the engine. The spark plug includes: a) a tubular metal shell fit in the bore of the cylinder head with a longitudinal direction of the metal shell perpendicular to the surface of the cylinder head, the metal shell having an end surface facing the combustion chamber and an inner shoulder that is formed on an inner periphery of the metal shell away from the end surface in the longitudinal direction; b) an insulator having an outer shoulder formed on an outer periphery of the insulator, the insulator being retained in the metal shell through an engagement between the inner shoulder of the metal shell and the outer shoulder of the insulator; c) an air pocket formed between the metal shell and the insulator, the air pocket extending, in the longitudinal direction of the metal shell, from the inner shoulder to the end surface of the metal shell to open to the combustion chamber; d) a center electrode secured in the insulator; and e) a ground electrode joined to the metal shell and facing the center electrode through a spark gap formed therebetween.

Further, in the second spark plug and cylinder head assembly, the end surface of the metal shell has an outer edge and an inner edge, and tapers from the outer edge to the inner edge in a direction toward the inner shoulder of the metal shell. A groove is formed between the metal shell and the cylinder head around the outer edge of the end surface of the metal shell.

With the above configuration of the second assembly, sparks induced in the spark gap will be shifted away from the surface of the cylinder head. Consequently, the flame core will be formed at a position sufficiently far from the surface of the cylinder head, facilitating the growth of the flame. As a result, the air/fuel mixture can be reliably ignited in the combustion chamber. Moreover, with the above configuration of the second assembly, it is unnecessary to form a communication hole in the metal shell of the spark plug and a communication path in the cylinder head and to accurately align the communication hole with the communication path. Accordingly, the second spark plug and cylinder head assembly can be made at low cost.

In one preferred embodiment of the invention, an inner wall of the cylinder head, which defines the bore of the cylinder head, includes a stepped end portion that adjoins to the surface of the cylinder head and has a larger diameter than other portions of the inner wall. The metal shell has an end portion that includes the end surface of the metal shell and faces the stepped end portion of the inner wall of the cylinder head in a direction perpendicular to the longitudinal direction of the metal shell. The groove is formed between an outer side surface of the end portion of the metal shell and the stepped end portion of the inner wall of the cylinder head.

In another embodiment of the invention, the metal shell has a stepped end portion that includes the end surface of the metal shell and has a smaller outer diameter than other portions of the metal shell. The cylinder head has an inner wall that defines the bore of the cylinder head and faces the stepped end portion of the metal shell in a direction perpendicular to the longitudinal direction of the metal shell. The groove is formed between an outer side surface of the stepped end portion of the metal shell and the inner wall of the cylinder head.

In yet another embodiment of the invention, the metal shell has an end portion that includes the end surface of the metal shell and protrudes from the surface of the cylinder head into the combustion chamber. An annular protrusion is formed on the surface of the cylinder head to surround the end portion of the metal shell. The groove is formed between an outer side surface of the end portion of the metal shell and an inner side surface of the protrusion.

Preferably, in the second spark plug and cylinder head assembly, the groove has a depth in the longitudinal direction of the metal shell in the range of 0.5 to 1.5 mm.

Moreover, in the second spark plug and cylinder head assembly, a taper angle θ of the end surface of the metal shell, which represents an angle between the end surface of the metal shell and the surface of the cylinder head, is preferably in the range of 20 to 40°.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings.

DESCRIPTION OF PREFERRED EMBODIMENTS

Figure 1:
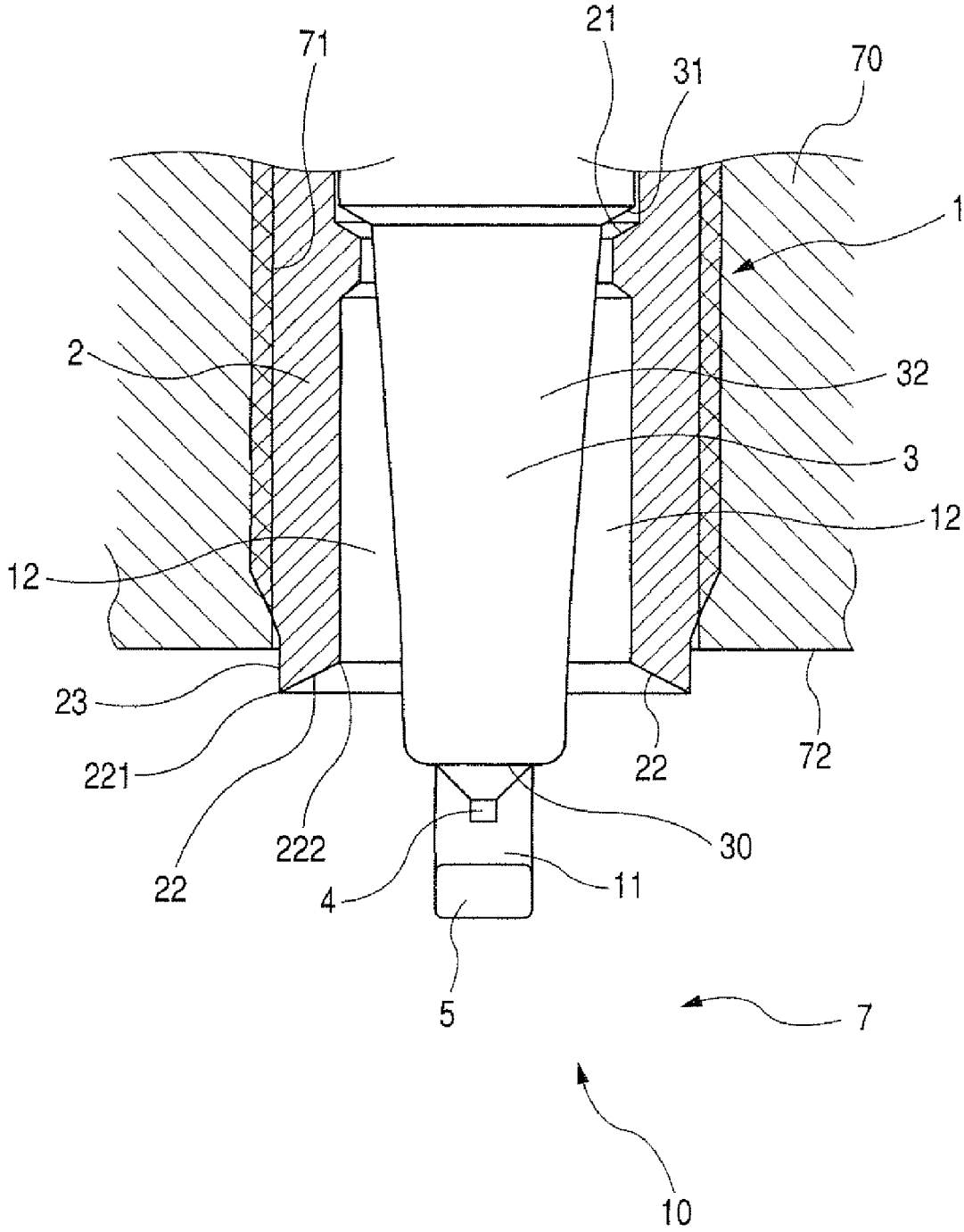
FIG. 1 is a partially cross-sectional side view showing the overall configuration of a spark plug and cylinder head assembly according to the first embodiment of invention.

Preferred embodiments of the present invention will be described hereinafter with reference to FIGS. 1-11.

It should be noted that, for the sake of clarity and understanding, identical components having identical functions in different embodiments of the invention have been marked, where possible, with the same reference numerals in each of the figures.

First Embodiment

FIG. 1 shows the overall configuration of a spark plug and cylinder head assembly 10 according to the first embodiment of the invention.

The spark plug and cylinder head assembly 10 is made by mounting a spark plug 1 in a cylinder head 70 of an engine, so as to ignite the air/fuel mixture in a combustion chamber 7 of the engine. More specifically, the cylinder head 70 has a spark plug bore 71, and an inside surface 72 which faces the combustion chamber 7 and on which the spark plug bore 71 opens. The spark plug 1 is mounted in the spark plug bore 71 of the cylinder head 70, with the axial direction of the spark plug 1 being perpendicular to the inside surface 72 of the cylinder head 70.

The spark plug 1 includes a tubular metal shell 2 for mounting the spark plug 1 in the spark plug bore 71 of the cylinder head 70, an insulator 3 retained in the metal shell 2, a center electrode 4 secured in the insulator 3, and a ground electrode 5 that faces the center electrode 4 through a spark gap 11 formed therebetween.

The metal shell 2 is substantially cylindrical in the present embodiment. The metal shell 2 is fit in the spark plug bore 71 of the cylinder head 70, with the axial direction of the metal shell 2 being perpendicular to the inside surface 72 of the cylinder head 70 and an annular, distalmost end surface 22 of the metal shell 2 facing the combustion chamber 7. The metal shell 2 has an inner shoulder 21 that is formed on an inner periphery of the metal shell 2; the insulator 3 has an outer shoulder 31 that is formed on an outer periphery of the insulator 3. The inner shoulder 21 of the metal shell 2 engages with the outer shoulder 31 of the insulator 3 via a packing (not shown), thereby fixing the insulator 3 with respect to the metal shell 2 in the axial direction.

Between the metal shell 2 and the insulator 3, there is formed an air pocket (i.e., an air gap) 12. The air pocket 12 extends, in the axial direction of the metal shell 2, from the inner shoulder 21 to the end surface 22 of the metal shell 2 to open to the combustion chamber 7.

The end surface 22 of the metal shell 2 has a radially outer edge 221 and a radially inner edge 222. The end surface 22 tapers from the outer edge 221, which most deeply protrudes from the inside surface 72 of the cylinder head 70 into the combustion chamber 7, to the inner edge 222 in a direction toward the inner shoulder 21 of the metal shell 2.

In the present embodiment, the end surface 22 has a linear shape on a cross section including the longitudinal axis of the metal shell 2.

The metal shell 2 further has male (i.e., external) threads formed on an outer periphery thereof; the male threads mate with female (i.e., internal) threads formed on an inner wall of the cylinder head 70 which defines the spark plug bore 71.

The insulator 3 is also substantially cylindrical and has an end 30 that protrudes from the end surface 22 of the metal shell 2. The insulator 3 also has a leg portion 32 which extends between the end 30 and the outer shoulder 31 that engages with the inner shoulder 21 of the metal shell 2. The leg portion 32 tapers from the outer shoulder 31 to the end 30, forming the air pocket 12 between the outer side surface of the leg portion 32 and the inner side surface of the metal shell 2.

The center electrode 4 is so secured in the insulator 3 as to partially protrude from the end 30 of the insulator 3. The ground electrode 5 has a substantially "L" shape, with one end joined to the metal shell 2 and the other end facing the center electrode 4 through the spark gap 11.

Figure 2:
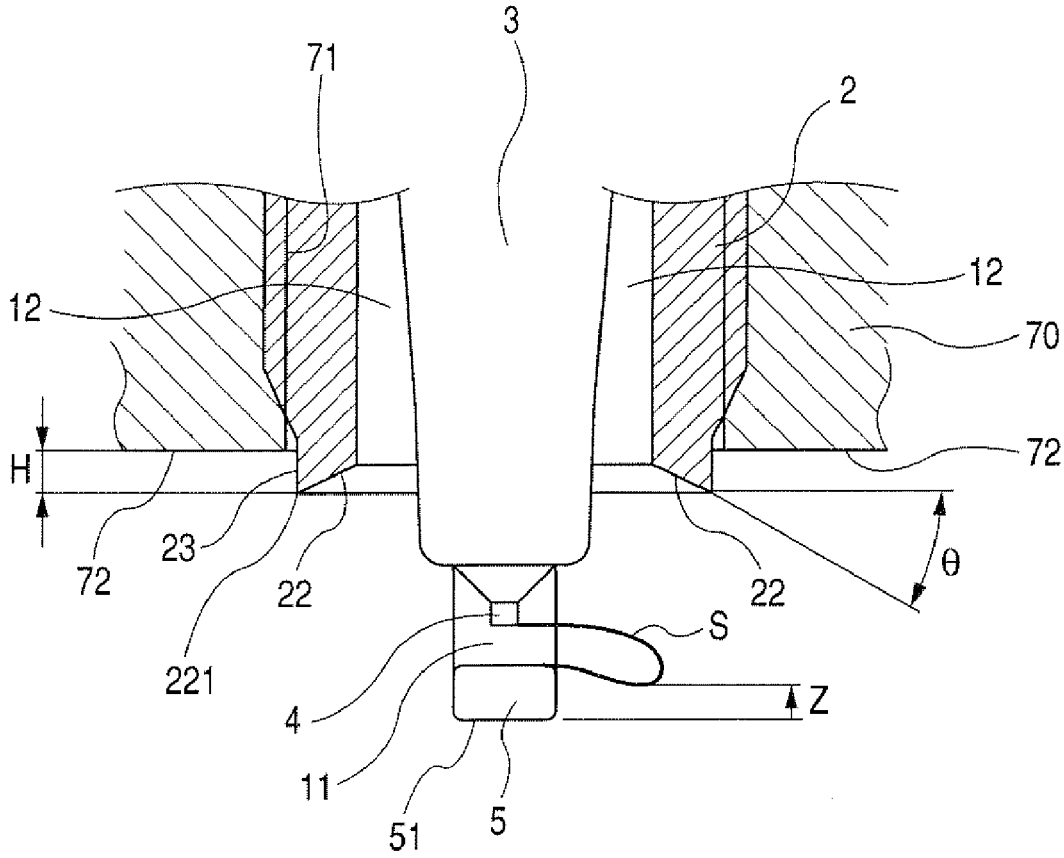
FIG. 2 is a partially cross-sectional side view illustrating parameters critical to the performance of the spark plug and cylinder head assembly according to the first embodiment.

Referring now to FIG. 2, in the present embodiment, the protruding height H of the metal shell 2, which represents the distance from the inside surface 72 of the cylinder head 70 to the outer edge 211 of the end surface 22 of the metal shell 2 in the axial direction of the metal shell 2, is in the range of 0.5 to 1.5 mm. In addition, the protruding height H also represents the axial length of an end portion 23 of the metal shell 2 which protrudes from the inside surface 72 of the cylinder head 70 and includes the end surface 22 of the metal shell 2.

Moreover, in the present embodiment, the taper angle θ of the end surface 22 of the metal shell 2, which represents the angle between the end surface 22 and the inside surface 72 of the combustion chamber 7, is in the range of 20 to 40°.

After having described the overall configuration of the spark plug and cylinder head assembly 10 according to the present embodiment, advantages thereof will be described hereinafter.

Figure 3:
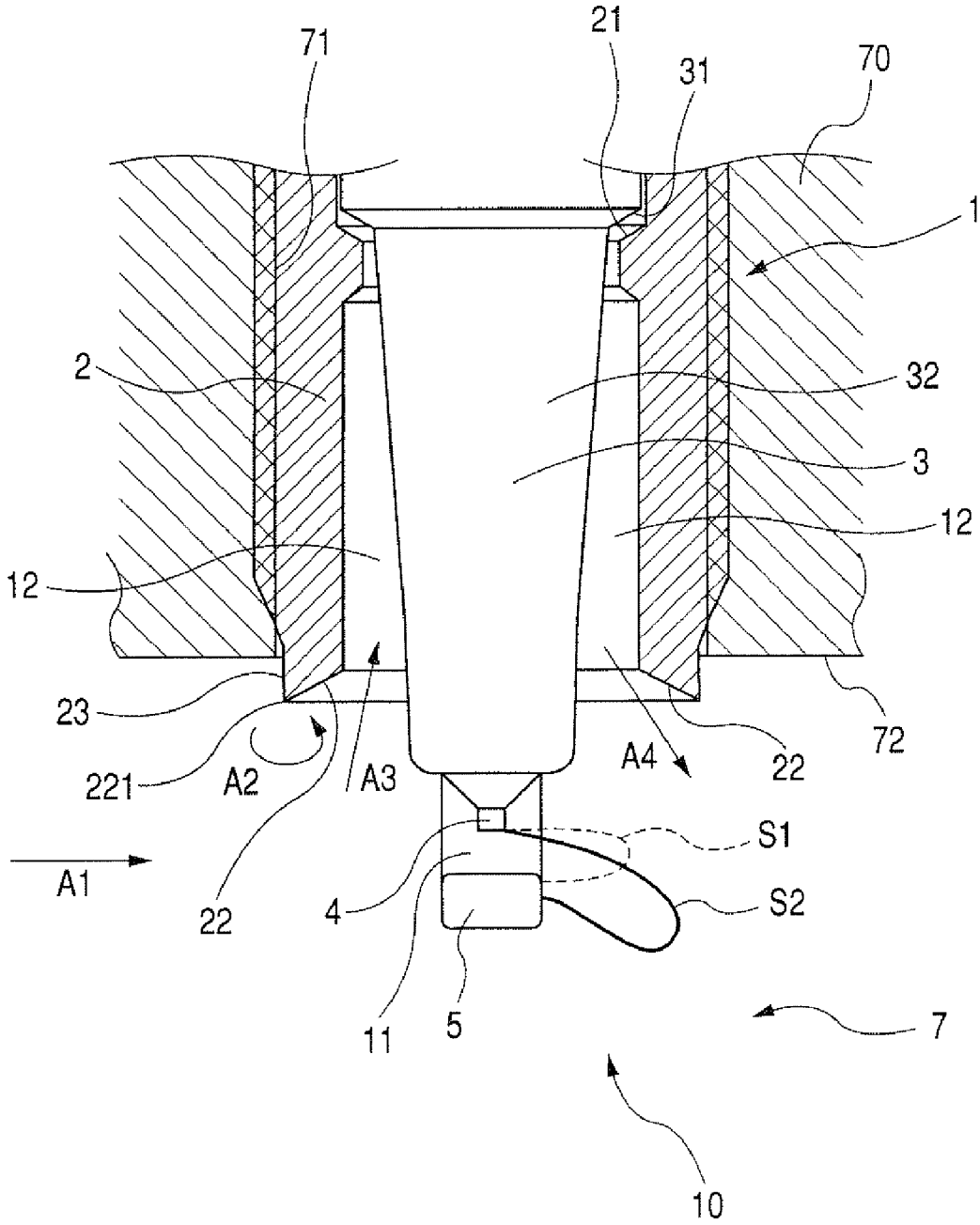
FIG. 3 is a partially cross-sectional side view illustrating advantages of the spark plug and cylinder head assembly according to the first embodiment.

Referring to FIG. 3, in the combustion chamber 7, there is generally formed a main flow A1 (swirl flow or tumble flow) in a direction perpendicular to the axial direction of the spark plug 1 (i.e., the axial direction of the metal shell 2).

If there was no particular change in the direction of the main flow A1, sparks induced in the spark gap 11 would be blown by the main flow A1 so that the discharge course of the sparks would be shifted, as depicted with a dashed line S1 in FIG. 3, only in the radial direction of the spark plug 1, i.e., only in the direction parallel to the inside surface 72 of the cylinder head 70.

However, in the present embodiment, the outer edge 221 of the end surface 22 of the metal shell 2 protrudes from the inside surface 72 of the cylinder head 7. Consequently, the main flow A1 will collide with the outer side surface of the end portion 23 of the metal shell 2, inducing a vortex A2 around the outer edge 221 of the end surface 22 of the metal shell 2. Due to the induced vortex A2, the direction of the main flow A1 is changed in the vicinity of the open end of the air pocket 12, forming an inward flow A3 that is directed to the inside of the air pocket 12.

Further, in the present embodiment, the end surface 22 of the metal shell 2 tapers from the radially outer edge 221 to the radially inner edge 222 in the direction toward the inner shoulder 21 of the metal shell 2. Therefore, it is easy for the inward flow A3 to advance into the air pocket 12 along the end surface 22 of the metal shell 2.

After reaching the inside of the air pocket 12, the air/fuel mixture making up the inward flow A3 will be expelled from the air pocket 12, forming an outward flow A4 that is directed to the outside of the air pocket 12.

Then, sparks induced in the spark gap 11 will be blown by the outward flow A4, so that the discharge course of the sparks will be shifted, as indicted with a solid line S2 in FIG. 3, in a direction away from the inside surface 702 of the cylinder head 70. Consequently, the flame core will be formed at a position sufficiently far from the inside surface 702 of the cylinder head 70, facilitating the growth of the flame. As a result, the air/fuel mixture can be reliably ignited in the combustion chamber 7.

Moreover, with the above configuration of the spark plug and cylinder head assembly 10, it is unnecessary to form a communication hole in the metal shell 2 and a communication path in the cylinder head 70 and to accurately align the communication hole with the communication path as taught by Japanese Utility Model Publication No. H5-87274. Accordingly, the spark plug and cylinder head assembly 10 can be made at low cost.

In the present embodiment, the taper angle θ of the end surface 22 of the metal shell 2 is specified to be in the range of 20 and 40°.

Specifying the taper angle θ as above, it is easy for the air/fuel mixture in the combustion chamber 7 to enter the air pocket 12 along the end surface 22 of the metal shell 2, forming the inward flow A3; it is also easy for the air/fuel mixture having entered the air pocket 12 to be expelled from the air pocket 12, forming the outward flow A4. Consequently, the air/fuel mixture can be more reliably ignited in the combustion chamber 7.

In addition, if the taper angle θ is smaller than 20°, it is difficult for a sufficient amount of the air/fuel mixture to enter the air pocket 12 to form the inward flow A3. On the contrary, if the taper angle θ is larger than 40°, it is difficult for the air/fuel mixture flowing along the inside surface 72 of the combustion chamber 7 to make a turn to flow along the end surface 22 of the metal shell 2; thus, it is difficult for the air/fuel mixture to enter the air pocket 12 to form the inward flow A3.

In the present embodiment, the protruding height H of the metal shell 2 is specified to be in the range of 0.5 to 1.5 mm.

Specifying the protruding height H as above, the vortex A2 can be easily and suitably induced around the outer edge 221 of the end surface 22 of the metal shell 2. Consequently, the inward flow A3 and outward flow A4 can be more easily formed, ensuring more reliable ignition of the air/fuel mixture in the combustion chamber 7.

In addition, if the protruding height H is smaller than 0.5 mm, it is difficult for the vortex A2 to be induced around the outer edge 221 of the end surface 22 of the metal shell 2. On the contrary, if the protruding height H is larger than 1.5 mm, the induced vortex A2 will be too large, making it difficult for the air/fuel mixture in the combustion chamber 7 to enter the air pocket 12.

Experiment 1

This experiment has been conducted to determine the relationship between the taper angle θ of the end surface 22 of the metal shell 2 and a discharge position Z of sparks induced in the spark gap 11.

In the experiment, samples of the spark plug and cylinder head assembly 10 were prepared, in all of which the protruding height H was 1 mm. However, for those samples, the taper angle θ was varied at intervals of 5° in the range of 15 to 45°.

Each of the samples was mounted in an engine, and the speed of the main flow A1 as depicted in FIG. 3 was set to 10 m/s. Then, an electric voltage was applied to the spark plug 1 of the sample to make the spark plug 1 repeatedly discharge sparks 100 times. For each time, the discharge course S of the sparks was observed to measure the discharge position Z. Here, the discharge position Z represents, as shown in FIG. 2, the minimum distance between the discharge course S of the sparks and a back surface 51 of the ground electrode 5; the back surface 51 is farthest in the spark plug 1 from the inside surface 72 of the cylinder head 70. In addition, it was predetermined for the discharge position Z to be negative (i.e., −) when the discharge course S extends beyond the back surface 51 and be positive (i.e., +) otherwise.

Figure 4:
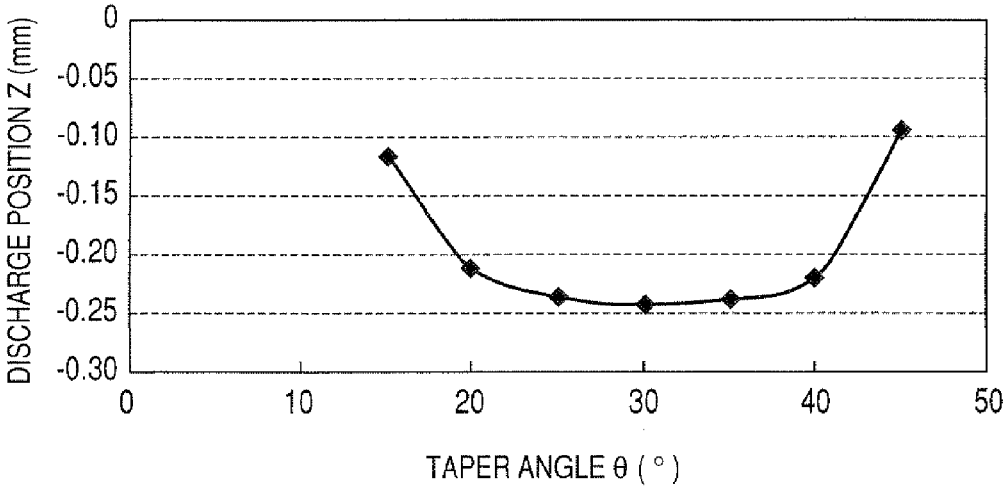
FIG. 4 is a graphical representation showing the results of Experiment 1 of the invention.

FIG. 4 shows the experimental results, where each plot indicates the average value of the discharge positions Z for the samples having the same taper angle θ.

As shown in FIG. 4, when the taper angle θ was in the range of 20 to 40°, the discharge course S of the sparks was greatly shifted away from the inside surface 72 of the cylinder head 70.

In comparison, when the taper angle θ was smaller than 20°, the discharge course S of the sparks was only slightly shifted away from the inside surface 72 of the cylinder head 70. This is because in this case, it was difficult for the air/fuel mixture flowing along the end surface 22 of the metal shell 2 to enter the air pocket 12 to form the inward flow A3 as depicted in FIG. 3.

Moreover, when the taper angle θ was larger than 40°, the discharge course S of the sparks was also only slightly shifted away from the inside surface 72 of the cylinder head 70. This is 20 because in this case, it was difficult for the air/fuel mixture flowing along the inside surface 72 of the cylinder head 70 to make a turn to flow along the end surface 22 of the metal shell 2; thus, it was difficult for the air/fuel mixture to enter the air pocket 12 to form the inward flow A3.

Accordingly, it is made clear from the above experimental results that to effectively shift sparks induced in the spark gap 11 away from the inside surface 72 of the cylinder head 70, the taper angle θ of the end surface 22 of the metal shell 2 is preferably in the range of 20 to 40°.

Experiment 2

This experiment has been conducted to determine the relationship between the protruding height H of the metal shell 2 and the discharge position Z of sparks induced in the spark gap 11.

In the experiment, samples of the spark plug and cylinder head assembly 10 were prepared, in all of which the taper angle θ of the end surface 22 of the metal shell 2 was 30°. However, for those samples, the protruding height H was varied at intervals of 0.5 mm in the range of 0 to 2.5 mm. Each of the samples was tested in the same way as in Experiment 1.

Figure 5:
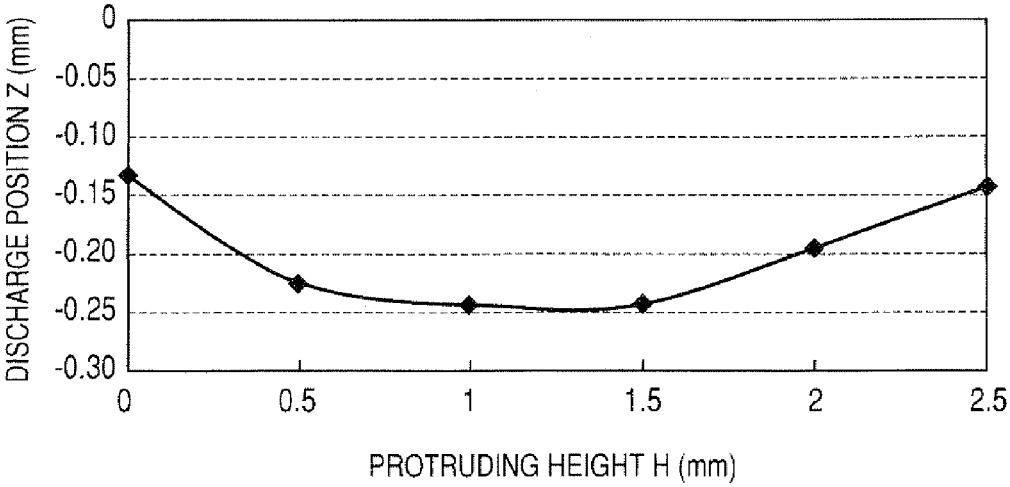
FIG. 5 is a graphical representation showing the results of Experiment 2 of the invention.

FIG. 5 shows the test results, where each plot indicates the average value of the discharge positions Z for the samples having the same protruding height H.

As shown in FIG. 5, when the protruding height H was in the range of 0.5 to 1.5 mm, the discharge course S of the sparks was greatly shifted away from the inside surface 72 of the cylinder head 70.

In comparison, when the protruding height H was smaller than 0.5 mm, the discharge course S of the sparks was only slightly shifted away from the inside surface 72 of the cylinder head 70. This is because in this case, it was difficult for the vortex A2 as depicted in FIG. 3 to be induced around the outer edge 221 of the end surface 22 of the metal shell 2; thus, it was difficult for the air/fuel mixture in the combustion chamber 7 to enter the air pocket 12 to form the inward flow A3 as depicted in FIG. 3.

Moreover, when the protruding height H was larger than 1.5 mm, the discharge course S of the sparks was also only slightly shifted away from the inside surface 72 of the cylinder head 70. This is because in this case, the vortex A2 induced around the outer edge 221 of the end surface 22 of the metal shell 2 was too large, making it difficult for the air/fuel mixture in the combustion chamber 7 to enter the air pocket 12 to form the inward flow A3.

Accordingly, it is made clear from the above experimental results that to effectively shift sparks induced in the spark gap 11 away from the inside surface 72 of the cylinder head 70, the protruding height H of the metal shell 2 is preferably in the range of 0.5 to 1.5 mm.

Second Embodiment

Figure 6:
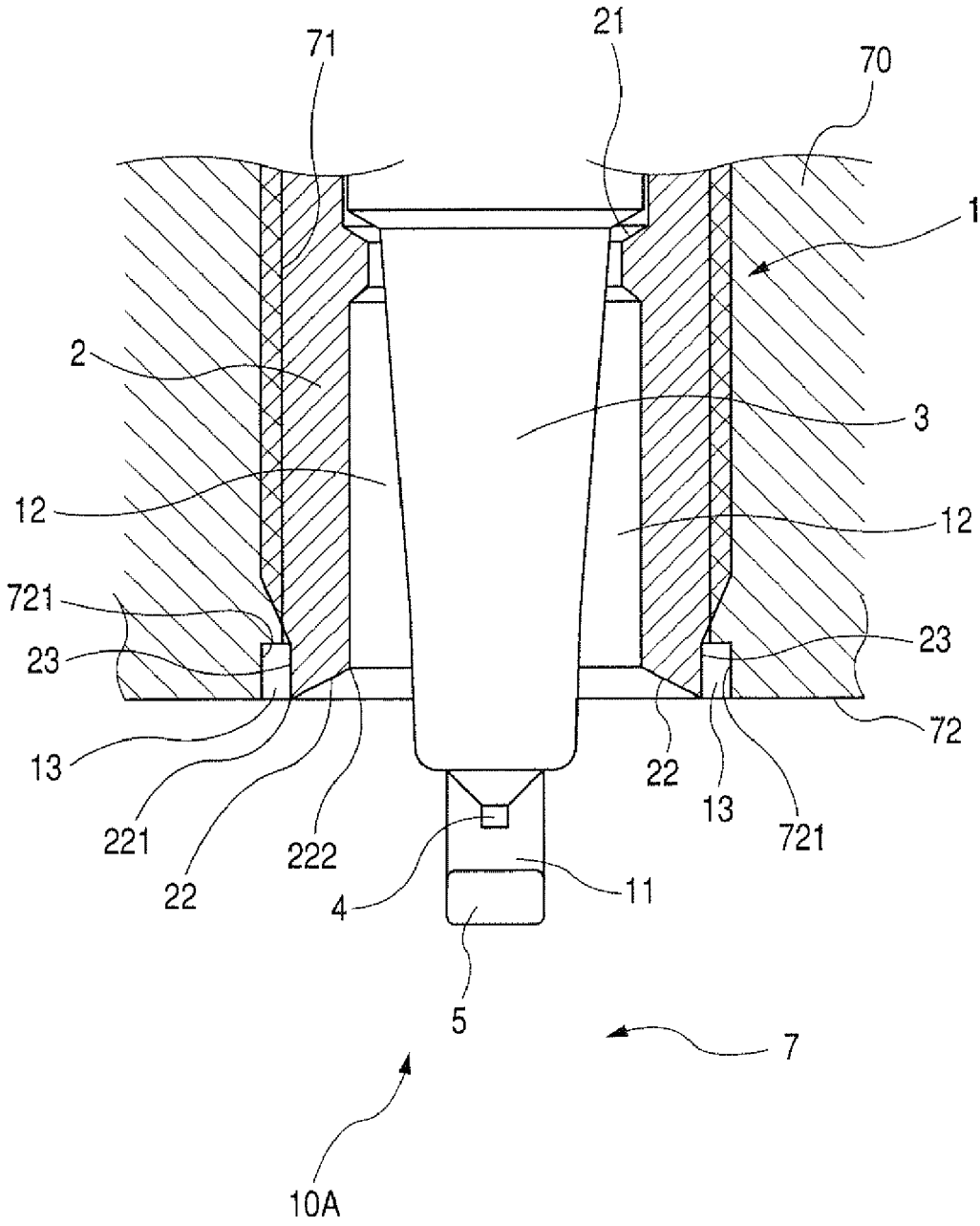
FIG. 6 is a partially cross-sectional side view showing the overall configuration of a spark plug and cylinder head assembly according to the second embodiment of the invention.

FIG. 6 shows the overall configuration of a spark plug and cylinder head assembly 10A according to the second embodiment of the invention.

As shown in FIG. 6, in the present embodiment, the radially outer edge 221 of the distalmost end surface 22 of the metal shell 2 is substantially flush with the inside surface 72 of the cylinder head 70. In other words, the outer edge 221 does not protrude from the inside surface 72.

Moreover, there is formed a groove 13 between the metal shell 2 and the cylinder head 70 around the outer edge 221 of the end surface 22 of the metal shell 2.

More specifically, in the present embodiment, the inner wall of the cylinder head 70, which defines the spark plug bore 71, includes a stepped end portion 721 that adjoins to the inside surface 72 of the cylinder head 70 and has a larger diameter than other portions of the inner wall. The metal shell 2 has an end portion 23 that includes the end surface 22 of the metal shell 2 and faces the stepped end portion 721 of the inner wall of the cylinder head 70 in the radial direction of the metal shell 2. The groove 13 is formed between the outer side surface of the end portion 23 of the metal shell 2 and the stepped end portion 721 of the inner wall of the cylinder head 70.

Figure 7:
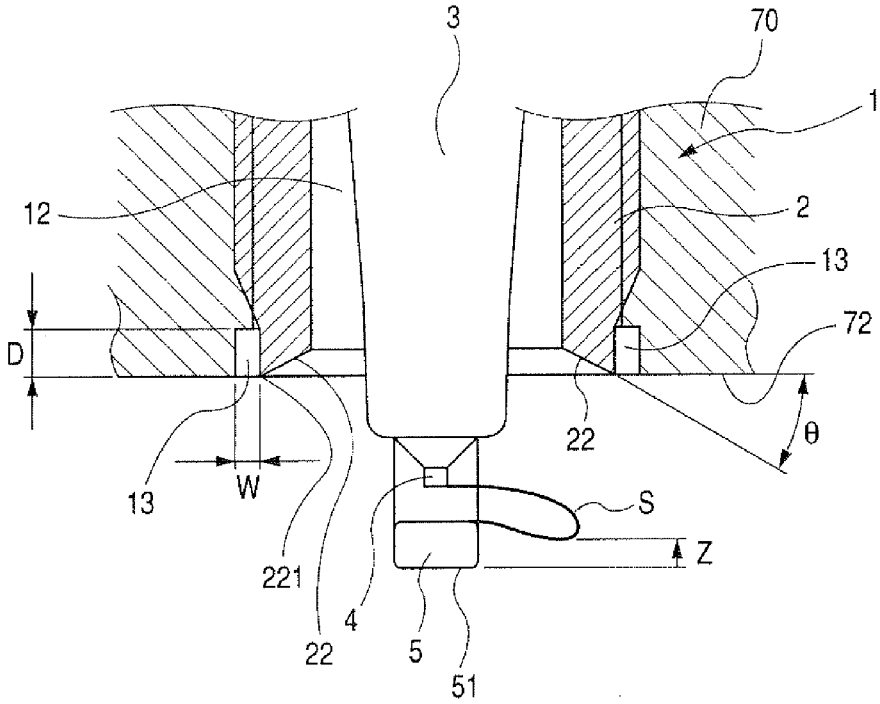
FIG. 7 is a partially cross-sectional side view illustrating parameters critical to the performance of the spark plug and cylinder head assembly according to the second embodiment.

Referring now to FIG. 7, the groove 13 has a width W in the radial direction of the metal shell 2 in the range of, for example, 0.5 to 2 mm. The groove 13 also has a depth D in the axial direction of the metal shell 2 in the range of, preferably, 0.5 to 1.5 mm.

After having described the overall configuration of the spark plug and cylinder head assembly 10A according to the present embodiment, advantages thereof will be described hereinafter.

In the present embodiment, as described above, there is formed the groove 13 around the outer side surface of the end portion 23 of the metal shell 2. Therefore, in operation, the air/fuel mixture flowing along the inside surface 72 of the cylinder head 70 will be disturbed by the groove 13, inducing a vortex A2 around the outer edge 221 of the end surface 22 of the metal shell 2; the vortex A2 is similar to that in the first embodiment. Further, due to the induced vortex A2, an inward flow A3 and an outward flow A4 as depicted in FIG. 3 will be formed in the same way as in the first embodiment. Consequently, sparks induced in the spark gap 11 will be shifted, by the outward flow A4, away from the inside surface 72 of the cylinder head 70. As a result, the air/fuel mixture can be reliably ignited in the combustion chamber 7.

Moreover, with the above configuration of the spark plug and cylinder head assembly 10A, it is unnecessary to form a communication hole in the metal shell 2 and a communication path in the cylinder head 70 and to accurately align the communication hole with the communication path as taught by Japanese Utility Model Publication No. H5-87274. Accordingly, the spark plug and cylinder head assembly 10A can be made at low cost.

In the present embodiment, the depth D of the groove 13 is specified to be in the range of 0.5 to 1.5 mm.

Specifying the depth D of the groove 13 as above, the vortex A2 can be easily and suitably induced around the outer edge 221 of the end surface 22 of the metal shell 2. Consequently, the inward flow A3 and outward flow A4 can be more easily formed, ensuring more reliable ignition of the air/fuel mixture in the combustion chamber 7.

In addition, if the depth D of the groove 13 is smaller than 0.5 mm, it is difficult for the vortex A2 to be induced around the outer edge 221 of the end surface 22 of the metal shell 2. On the contrary, if the depth D of the groove 13 is larger than 1.5 mm, the induced vortex A2 will be too large, making it difficult for the air/fuel mixture in the combustion chamber 7 to enter the air pocket 12.

Furthermore, in the present embodiment, the taper angle θ of the end surface 22 of the metal shell 2 is also specified to be in the range of 20 and 40°, which provides the same advantages as in the first embodiment.

Experiment 3

This experiment has been conducted to determine the relationship between the depth D of the groove 13 and the discharge position Z of sparks induced in the spark gap 11.

In the experiment, samples of the spark plug and cylinder head assembly 10A were prepared, in all of which the taper angle θ of the end surface 22 of the metal shell 2 was 30° and the width W of the groove 13 was 1 mm. However, for those samples, the depth D of the groove 13 was varied at intervals of 0.5 mm in a range of 0 to 2.5 mm. Each of the samples was tested in the same way as in Experiment 1.

Figure 8:
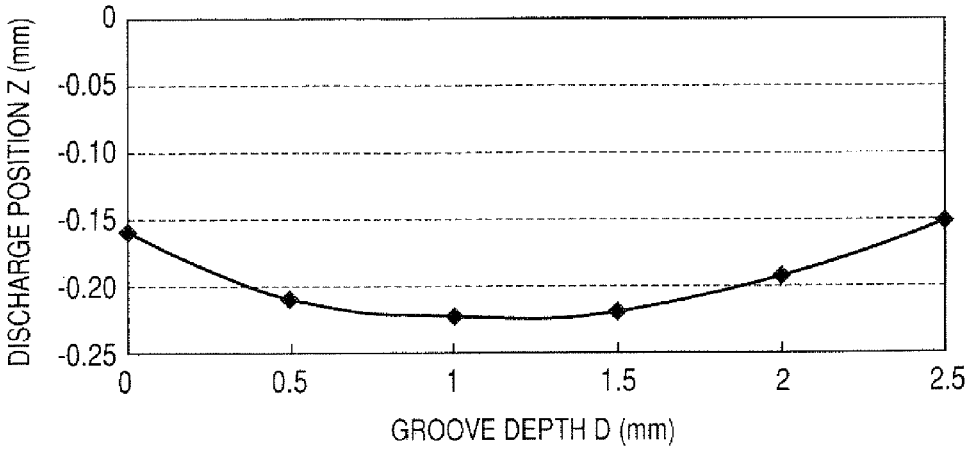
FIG. 8 is a graphical representation showing the results of Experiment 3 of the invention.

FIG. 8 shows the test results, where each plot indicates the average value of the discharge positions Z for the samples having the same depth D of the groove 13.

As shown in FIG. 8, when the depth D of the groove 13 was in the range of 0.5 to 1.5 mm, the discharge course of the sparks was greatly shifted away from the inside surface 72 of the cylinder head 70.

In comparison, when the depth D of the groove 13 was smaller than 0.5 mm, the discharge course of the sparks was only slightly shifted away from the inside surface 72 of the cylinder head 70. This is because in this case, it was difficult for the vortex A2 to be induced around the outer edge 221 of the end surface 22 of the metal shell 2; thus, it was difficult for the air/fuel mixture in the combustion chamber 7 to enter the air pocket 12 to form the inward flow A3 as depicted in FIG. 3.

Moreover, when the depth D of the groove 13 was larger than 1.5 mm, the discharge course of the sparks was also only slightly shifted away from the inside surface 72 of the cylinder head 70. This is because in this case, the vortex A2 induced around the outer edge 221 of the end surface 22 of the metal shell 2 was too large, making it difficult for the air/fuel mixture in the combustion chamber 7 to enter the air pocket 12 to form the inward flow A3.

Accordingly, it is made clear from the above experimental results that to effectively shift sparks induced in the spark gap 11 away from the inside surface 72 of the cylinder head 70, the depth D of the groove 13 is preferably in the range of 0.5 to 1.5 mm.

Third Embodiment

Figure 9:
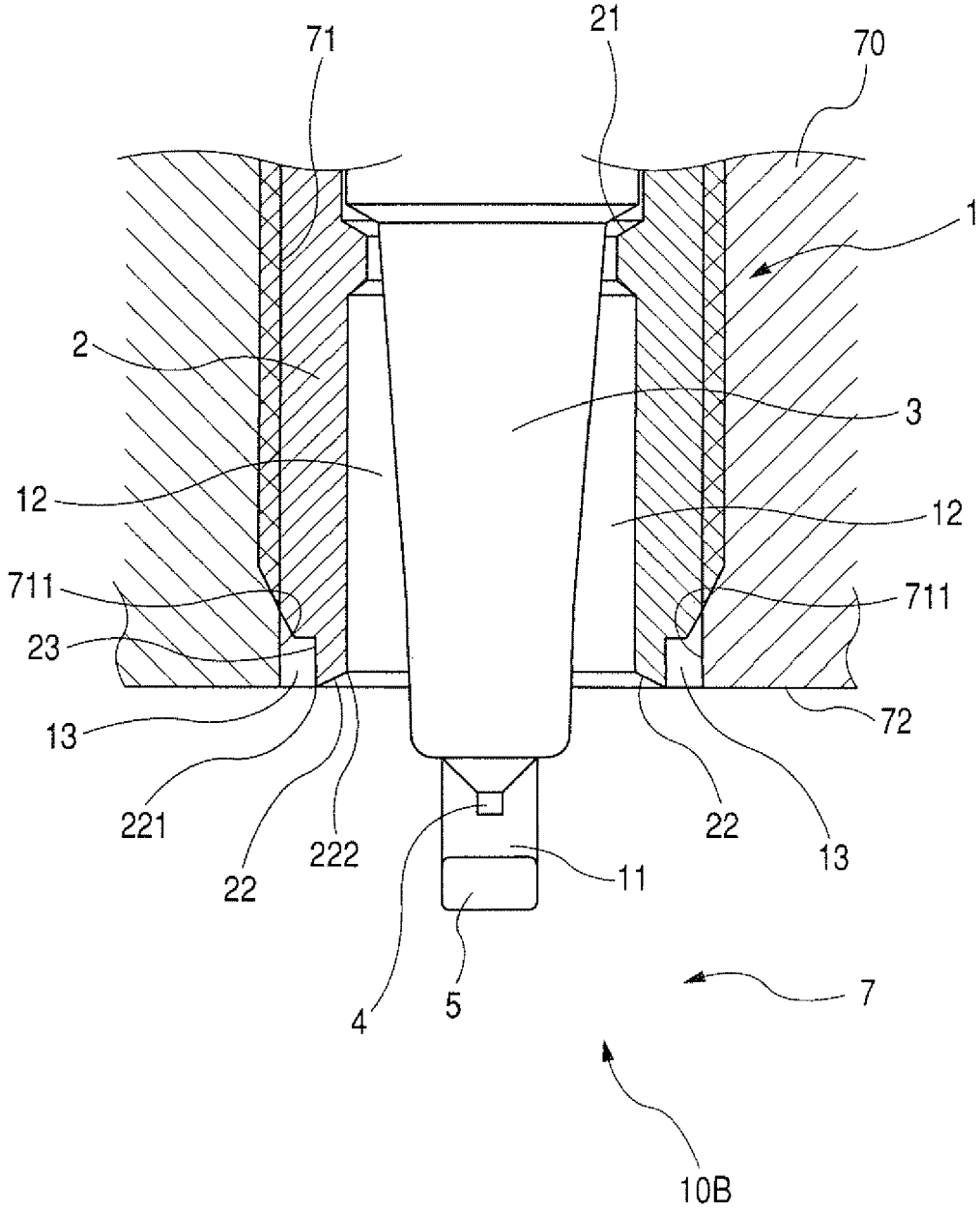
FIG. 9 is a partially cross-sectional side view showing the overall configuration of a spark plug and cylinder head assembly according to the third embodiment of the invention.

FIG. 9 shows the overall configuration of a spark plug and cylinder head assembly 10B according to the third embodiment of the invention.

As shown in FIG. 9, in the present embodiment, the radially outer edge 221 of the distalmost end surface 22 of the metal shell 2 is substantially flush with the inside surface 72 of the cylinder head 70, as in the second embodiment.

However, unlike in the second embodiment, the inner wall of the cylinder head 70 in the present embodiment has no stepped end portion; instead, the metal shell 2 in the present embodiment has a stepped end portion 23 that includes the end surface 22 of the metal shell 2 and has a smaller outer diameter than other portions of the metal shell 2. Between the outer side surface of the stepped end portion 23 of the metal shell 2 and the inner wall of the cylinder head 70 which defines the spark plug bore 71, there is formed a groove 13 that is recessed from the inside surface 72 of the cylinder head 70.

Further, as in the second embodiment, the groove 13 in the present embodiment also has a width in the radial direction of the metal shell 2 in the range of, for example, 0.5 to 2 mm, and a depth in the axial direction of the metal shell 2 in the range of, preferably, 0.5 to 1.5 mm; the taper angle of the end surface 22 of the metal shell 2 is preferably in the range of 20 and 40°.

The above-described spark plug and cylinder head assembly 10B according to the present embodiment also has the advantages of the spark plug and cylinder head assembly 10A according to the second embodiment.

Moreover, the spark plug and cylinder head assembly 10B has an additional advantage of making it possible to easily form the groove 13 without performing any additional process for the cylinder head 7.

Fourth Embodiment

Figure 10:
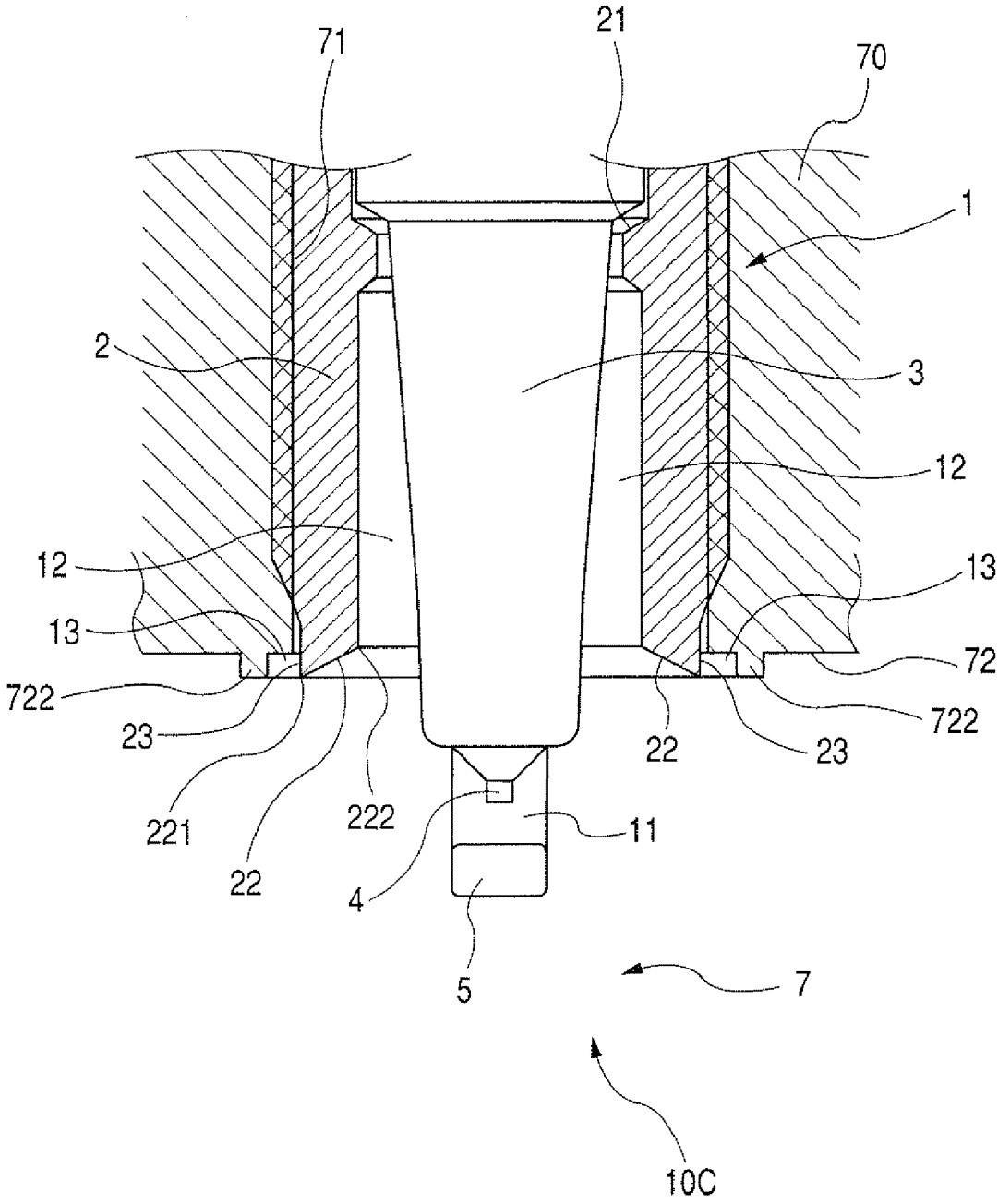
FIG. 10 is a partially cross-sectional side view showing the overall configuration of a spark plug and cylinder head assembly according to the fourth embodiment of the invention.

FIG. 10 shows the overall configuration of a spark plug and cylinder head assembly 10C according to the fourth embodiment of the invention.

As shown in FIG. 10, in the present embodiment, the metal shell 2 has an end portion 23 that includes the end surface 22 of the metal shell 2 and protrudes from the inside surface 72 of the cylinder head 70.

Moreover, on the inside surface 72 of the cylinder head 70, there is formed an annular protrusion 722 that surrounds the end portion 23 of the metal shell 2 with the same protruding height from the inside surface 72 as the end portion 23. The protruding height of both the protrusion 722 and the end portion 23 of the metal shell 2 is preferably in the range of 0.5 to 1.5 mm.

Between the inner side surface of the protrusion 722 and the outer side surface of the end portion 23 of the metal shell 2, there is formed a groove 13 that has a width in the radial direction of the metal shell 2 in the range of, for example, 0.5 to 2 mm.

In addition, the taper angle of the end surface 22 of the metal shell 2 is preferably in the range of 20 and 40°.

The above-described spark plug and cylinder head assembly 10C according to the present embodiment has the same advantages as the spark plug and cylinder head assembly 10A according to the second embodiment.

Comparative Example

Figure 11:
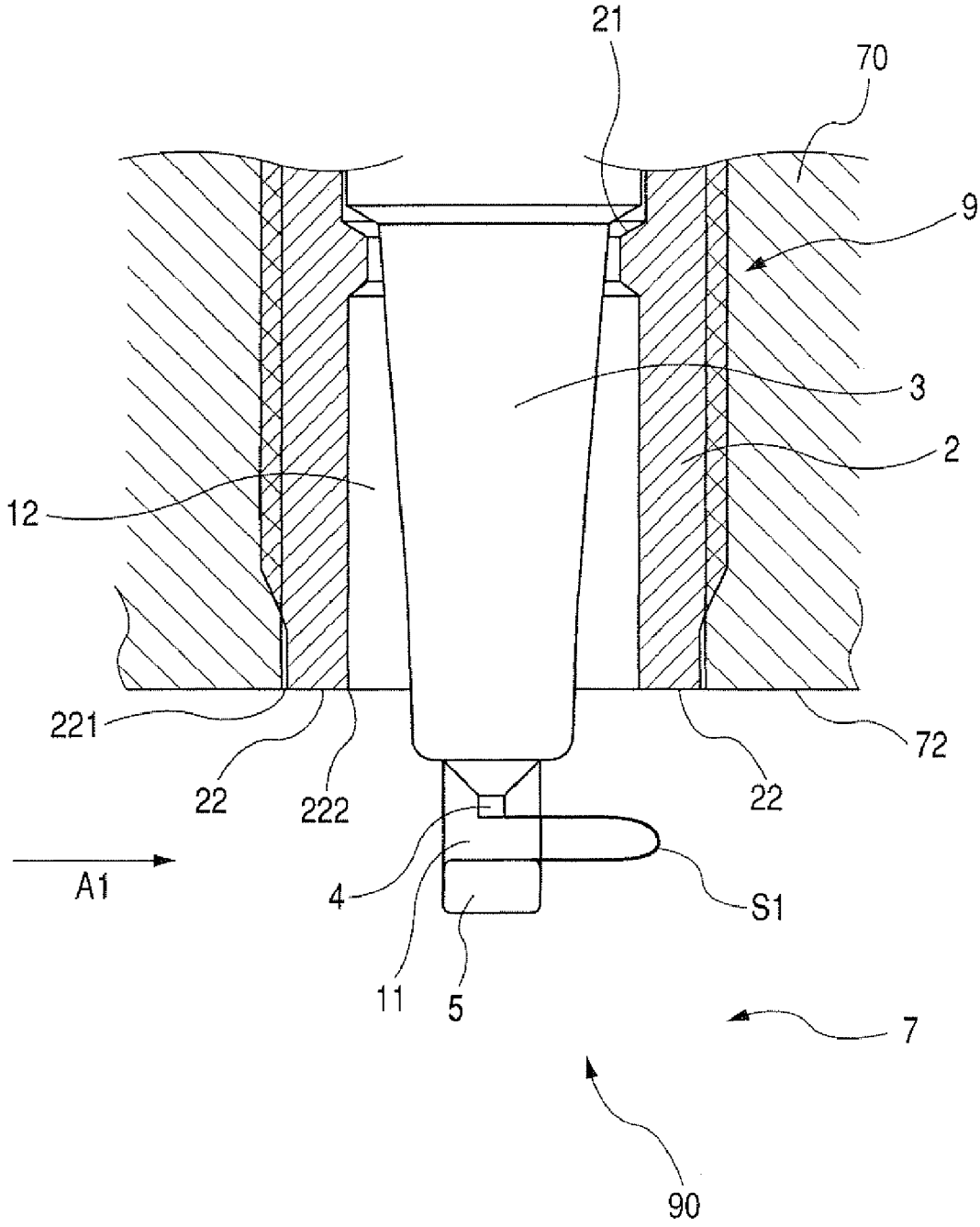
FIG. 11 is a partially cross-sectional side view showing the overall configuration of a spark plug and cylinder head assembly for comparison with those according to the preferred embodiments of the invention.

FIG. 11 shows the overall configuration of a spark plug and cylinder head assembly 90 for comparison with the spark plug and cylinder head assemblies 10-10C according to the previous embodiments.

The spark plug and cylinder head assembly 90 is made by mounting a spark plug 9 in a cylinder head 70 of an engine.

As shown in FIG. 11, in this comparative example, the end surface 22 of the metal shell 2 is perpendicular to the axial direction of the metal shell 2. In other words, the end surface 22 does not taper from the outer edge 221 to the inner edge 222 in a direction toward the inner shoulder 21 of the metal shell 2.

Moreover, the end surface 22 of the metal shell 2 is flush with the inside surface 72 of the cylinder head 70. In other words, the outer edge 221 of the end surface 22 does not protrude from the inside surface 72 of the cylinder head 70.

Compared to the spark plug and cylinder head assemblies 10-10C according to the previous embodiments, the assembly 90 has the following disadvantages.

As described above, in the combustion chamber 7, there is generally formed a main flow A1 (swirl flow or tumble flow) in a direction perpendicular to the axial direction of the spark plug 1 (i.e., in a direction parallel to the inside surface 72 of the cylinder head 70).

In the spark plug and cylinder head assembly 90, the end surface 22 of the metal shell 2 is not only flush with the inside surface 72 of the cylinder head 70 but also parallel with the inside surface 72. Therefore, the metal shell 2 will not cause any change in the direction of the main flow A1.

Consequently, sparks induced in the spark gap 11 will be blown by the main flow A1 so that the discharge course of the sparks will be only shifted, as depicted with a solid line S1 in FIG. 11, in the direction parallel to the inside surface 72 of the cylinder head 70. That is to say, the discharge course of the sparks will not be shifted in a direction away from the inside surface 72 of the combustion chamber 7.

As a result, the flame core will be formed at a position close to the inside surface 72 of the cylinder head 70; thus, the flame core will be cooled by the inside surface 72, hindering the growth of the flame.

Accordingly, with the above configuration of the spark plug and cylinder head assembly 90, it is difficult to ensure reliable ignition of the air/fuel mixture in the combustion chamber 7.

While the above particular embodiments of the invention have been shown and described, it will be understood by those skilled in the art that various modifications, changes, and improvements may be made without departing from the spirit of the invention.

For example, in the previous embodiments, the end surface 22 of the metal shell 2 has a linear shape on a cross section including the longitudinal axis of the metal shell 2.

However, the end surface 22 may also have the shape of a curve on the cross section including the longitudinal axis of the metal shell 2. Moreover, in this case, it is preferable that the curve be a convex curve. With the convex curve-shaped end surface 22, it would be easier for the air/fuel mixture flowing along the inside surface 72 of the cylinder head 70 to enter the air pocket 12.

What is claimed is:

1. A spark plug and cylinder head assembly comprising:

a cylinder head of an engine having formed therein a bore, the cylinder head also having a surface which faces a combustion chamber of the engine and on which the bore opens; and a spark plug for igniting an air/fuel mixture in the combustion chamber of the engine, the spark plug including a) a tubular metal shell fit in the bore of the cylinder head with a longitudinal direction of the metal shell perpendicular to the surface of the cylinder head, the metal shell having a distalmost end surface facing the combustion chamber and an inner shoulder that is formed on an inner periphery of the metal shell spaced away from the distalmost end surface in the longitudinal direction, b) an insulator having an outer shoulder formed on an outer periphery of the insulator, the insulator being retained in the metal shell through an engagement between the inner shoulder of the metal shell and the outer shoulder of the insulator, c) an air pocket formed between the metal shell and the insulator, the air pocket extending, in the longitudinal direction of the metal shell, from the inner shoulder to the end surface of the metal shell to open to the combustion chamber, d) a center electrode secured in the insulator, and e) a ground electrode joined to the metal shell and facing the center electrode through a spark gap formed therebetween, wherein the distalmost end surface of the metal shell has a radially outer edge and a radially inner edge, and tapers from the radially outer edge to the radially inner edge in a direction toward the inner shoulder of the metal shell, whereby the end surface tapers from the distalmost and radially outermost edge thereof to the radially inner edge, a groove is formed between the metal shell and the cylinder head around the outer edge of the end surface of the metal shell, and the groove has a depth in the longitudinal direction of the metal shell in a range of 0.5 to 1.5 mm.

2. The spark plug and cylinder head assembly as set forth in claim 1, wherein the metal shell has a stepped end portion that includes the end surface of the metal shell and has a smaller outer diameter than other portions of the metal shell, the cylinder head has an inner wall that defines the bore of the cylinder head and faces the stepped end portion of the metal shell in a direction perpendicular to the longitudinal direction of the metal shell, and the groove is formed between an outer side surface of the stepped end portion of the metal shell and the inner wall of the cylinder head.

3. The spark plug and cylinder head assembly as set forth in claim 1, wherein a taper angle θ of the end surface of the metal shell, which represents an angle between the end surface of the metal shell and the surface of the cylinder head, is in a range of 20 to 40°.

* * * * *